US007175572B2

(12) United States Patent
Stonecipher

(10) Patent No.: US 7,175,572 B2
(45) **Date of Patent: *Feb. 13, 2007**

(54) OPEN HAND GRIPPED EXERCISE DEVICE

(75) Inventor: William L. Stonecipher, Overland Park, KS (US)

(73) Assignee: Top Form Fitness Systems, Inc, Overland Park, KS (US)

( * ) Notice: Subject to any disclaimer, the term of this patent is extended or adjusted under 35 U.S.C. 154(b) by 139 days.

This patent is subject to a terminal disclaimer.

(21) Appl. No.: 10/827,561

(22) Filed: Apr. 19, 2004

(65) Prior Publication Data

US 2004/0198568 A1 Oct. 7, 2004

Related U.S. Application Data

(63) Continuation-in-part of application No. 10/004,908, filed on Nov. 2, 2001, now Pat. No. 6,726,599.

(51) Int. Cl.
*A63B 21/072* (2006.01)

(52) U.S. Cl. ..... 482/106; 482/49; 482/50; 482/910

(58) Field of Classification Search ..... 482/106–110, 482/44–47, 49, 92, 93, 50; D21/679–682
See application file for complete search history.

(56) References Cited

U.S. PATENT DOCUMENTS

| | | | | |
|---|---|---|---|---|
| 1,366,200 | A * | 1/1921 | Matysek | 482/106 |
| 2,475,565 | A | 7/1949 | Bidak | |
| 3,033,565 | A | 5/1962 | Wolski | |
| 3,330,558 | A | 7/1967 | Simons | |
| 3,690,655 | A | 9/1972 | Chapman | |
| 3,982,755 | A | 9/1976 | Sarich | |
| 4,632,391 | A | 12/1986 | Orak | |
| 4,867,444 | A * | 9/1989 | Castillo | 482/106 |
| 4,869,491 | A | 9/1989 | Nolan | |
| 4,901,999 | A * | 2/1990 | Schott | 482/45 |
| 4,973,043 | A | 11/1990 | Nolan | |
| 5,116,297 | A | 5/1992 | Stonecipher | |
| 5,449,333 | A | 9/1995 | Carter | |
| 5,490,817 | A * | 2/1996 | Stander et al. | 482/46 |
| 5,496,243 | A * | 3/1996 | Allen | 482/106 |
| 5,692,944 | A | 12/1997 | Pellicone | |
| 5,788,617 | A | 8/1998 | Paris | |
| 5,941,799 | A * | 8/1999 | Bergdorf | 482/44 |
| 6,129,650 | A * | 10/2000 | Wedge, Jr. | 482/139 |
| 6,592,499 | B2 * | 7/2003 | Parker | 482/106 |
| 6,663,542 | B1 * | 12/2003 | Trabbic | 482/106 |
| 6,726,599 | B1 * | 4/2004 | Stonecipher | 482/44 |
| 6,770,016 | B1 * | 8/2004 | Anderson et al. | 482/106 |
| 7,081,072 | B2 * | 7/2006 | Allen | 482/106 |

* cited by examiner

*Primary Examiner*—Stephen R. Crow
*Assistant Examiner*—Allana Lewin
(74) *Attorney, Agent, or Firm*—Erickson & Kleypas, L.L.C.

(57) ABSTRACT

A hand held exercise device includes a pair of dumbbells rotatably attached to a cross bar and which can be held between the hands of a user gripping the dumbbells. Grips are preferably positionable around the dumbbells to require the user to hold the exercise device in an open hand grip. The dumbbells are removably connected to the cross bar to permit use of the dumbbells separately, with or without the grips.

7 Claims, 4 Drawing Sheets

18
20
22
9
3
18
22
30
28
4
7
4
2
16
6
32
1
22
20
7

1
3
2
7
7
16
6
4
1
1
6
7

Fig. 3.
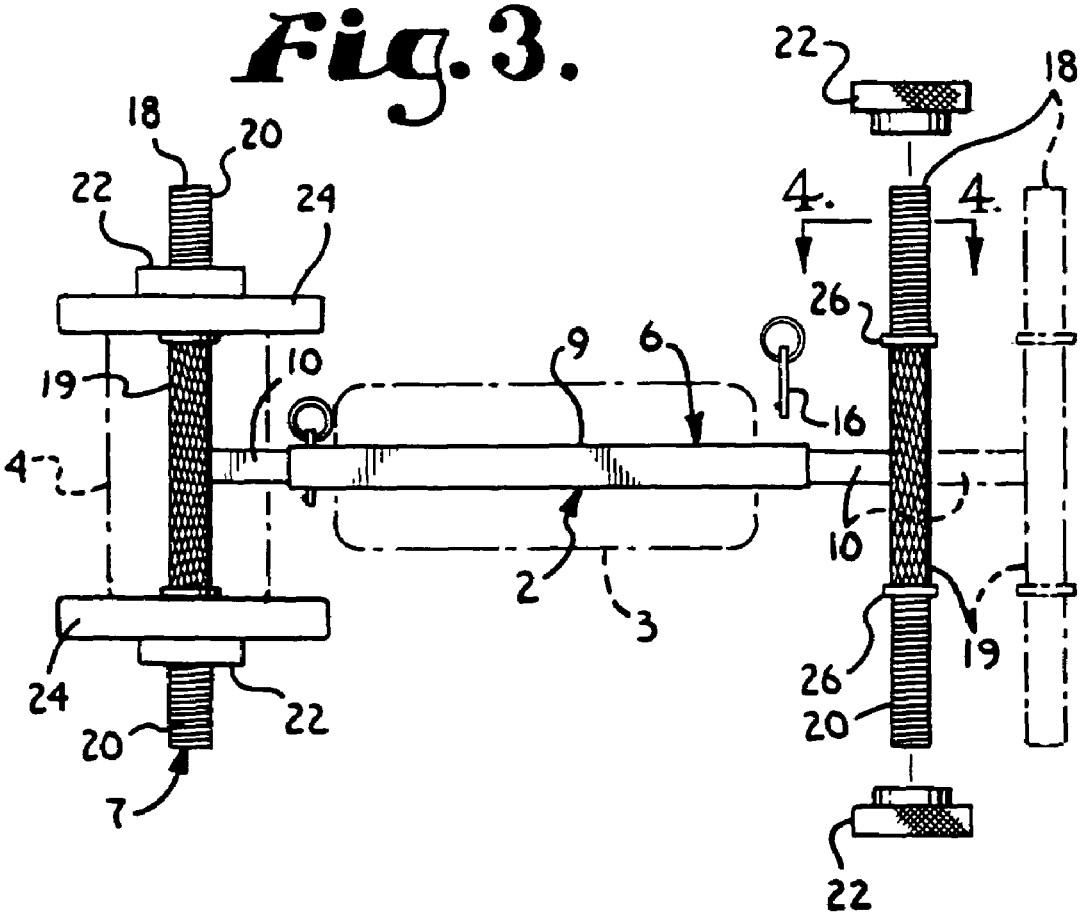
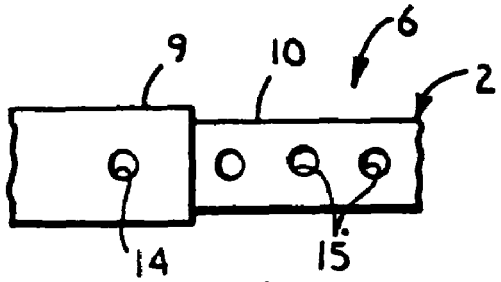
Fig. 4.

OPEN HAND GRIPPED EXERCISE DEVICE

CROSS-REFERENCE TO RELATED APPLICATIONS

This U.S. Patent Application is a continuation-in-part of U.S. patent application Ser. No. 10/004,908 filed Nov. 2, 2001 and issued Apr. 27, 2004 as U.S. Pat. No. 6,726,599.

BACKGROUND OF THE INVENTION

The present invention relates to hand held exercise devices.

Physical vitality and fitness are improved and maintained by exertion of the body. Various exercises and activities have been devised to enhance overall fitness and to condition specific muscles and muscle groups. Resistance exercise, also called strength training, increases muscle strength and mass and bone strength and improves metabolism. Resistance training can employ free weights, weight machines, and calisthenics. With free weights, such as dumbbells or barbells, the exerciser determines the ranges of motions of the weights as they are lifted. On the other hand, weight machines use the structure of the machine to control the type of movements which can be applied to lifting captive weights. In calisthenics, such as chin-ups, push-ups, sit-ups, "jumping jacks", and the like, the weight of the exerciser's own body is used as a resistence force to be worked against.

Exercises can be classified by their effects on muscles and according to the character of motion involved. In isometric exercises, muscles contract, but there is no decrease in length. Some muscles may work against other muscles or against a fixed, or relatively fixed, object. Isokinetic exercise refers to exercises which permit maximum muscle contraction throughout the full range of movement of a joint associated with the muscle. Pliometric exercises refer generally to types of exercise in which movement of an object is halted, then reversed in direction of movement. An example of a pliometric exercise is catching and then throwing back a "medicine" ball.

There are a large number of devices, apparatus, and equipment for use in performing various types of exercises, such as the weight machines and free weights mentioned above. Weight machines and barbells tend to be large, heavy, and expensive, as do various type of treadmill machines, weight and exercise benches, and spring based exercise machines. There are also a large number of small, inexpensive devices for use in specific types of strength training and exercises. A large proportion of exercise devices are designed for use by manual grasping and manipulation. In most cases, such grasped devices are sized to be gripped with closed, or mostly closed, hands.

Although there are benefits to be realized using such closed hand gripped devices, it has been found that there are also benefits to exercise devices which cannot be gripped with a closed hand, but which must be supported with open hands. The benefits of such an open handed device involve the necessity of combining isometric muscle contractions with otherwise isokinetic or pliometric types of exercises. The isometric contractions result from the need to clamp or compress such a device between the open palms of the hands to support the device.

SUMMARY OF THE INVENTION

The present invention comprises a hand held exercise device including a pair of dumbbells rotatably attached to a cross bar and which can be held between the hands of a user gripping the dumbbells. Grips are preferably positionable around the dumbbells to require the user to hold the exercise device in an open hand grip to provide muscle exercising benefits resulting from performing exercises with a weighted device which is supported by the user's hands in an open configuration. The dumbbells are also preferably removably connected to the cross bar to permit use of the dumbbells separately, with or without the grips.

The cross bar is preferably adjustable in length and includes a center section with end sections telescopically engaged thereto. Removable fasteners secure the end sections to the center section. The dumbbells may be rotatably and removably connected to the end sections of the cross bar by threaded connectors, including a male threaded member projecting axially outward from the distal end of each end section and a threaded receiver formed in each dumbbell. Other removable connectors which permit rotation or pivoting of the dumbbells with respect to the cross-bar could be utilized. In addition, the dumbbells may be fixedly connected in T-shaped joints to the end sections of the cross-bar. Opposite ends of the dumbbells may be adapted to receive additional weights. The ends of the dumbbells may be threaded to receive retainer collars to hold combinations of conventional plate type weights on the dumbbells.

The fully assembled exercise device or the separated dumbbells can be used in a number of types of exercise devices, such as free weight types of lifting exercises like presses and curls and other lifting exercises, such as those in which one arm opposes movement of the other. The exercise device can also be used to enhance the effect of calisthenic type exercises, such as sit-ups, jumps of various kinds, abdominal twists, lunges, and even running. In most of the preferred exercises with the device, it is gripped in an open handed manner. This requires isometric contraction of muscles used for effecting a grip on the device.

The cross bar can be extended to increase the separation of the dumbbells for exercises which make use of rotational momentum. The extended configuration can also enable a more secure grip of the device, such as if additional weights are placed on the dumbbells. The separability of the dumbbells from the cross-bar facilitates packing and storing the components of the exercise device and permits the dumbbells to be utilized separately.

The hand held exercise device may be stored in a rigid plastic carrying case that also functions as a step for step type aerobic exercises. The carrying case is preferably adapted to store the hand held exercise device including additional weight plates, a flexible mat on which to lay when stretching, doing sit-ups or other fitness related activity, and recorded exercise programs demonstrating exercises which can be performed using the hand held exercise device, carrying case and its contents.

Other objects and advantages of this invention will become apparent from the following description taken in relation to the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE DRAWINGS

FIG. 3 is a partially exploded, side elevational view of frame members and weighted collars of the exercise device, with grip cushions, and an alternative position of an end bar shown in phantom lines.

FIG. 4 is a greatly enlarged sectional view taken on line 4—4 of FIG. 3 and illustrates a series of apertures to enable extension of a center bar of the exercise device of the present invention.

DETAILED DESCRIPTION OF THE INVENTION

Figure 1:
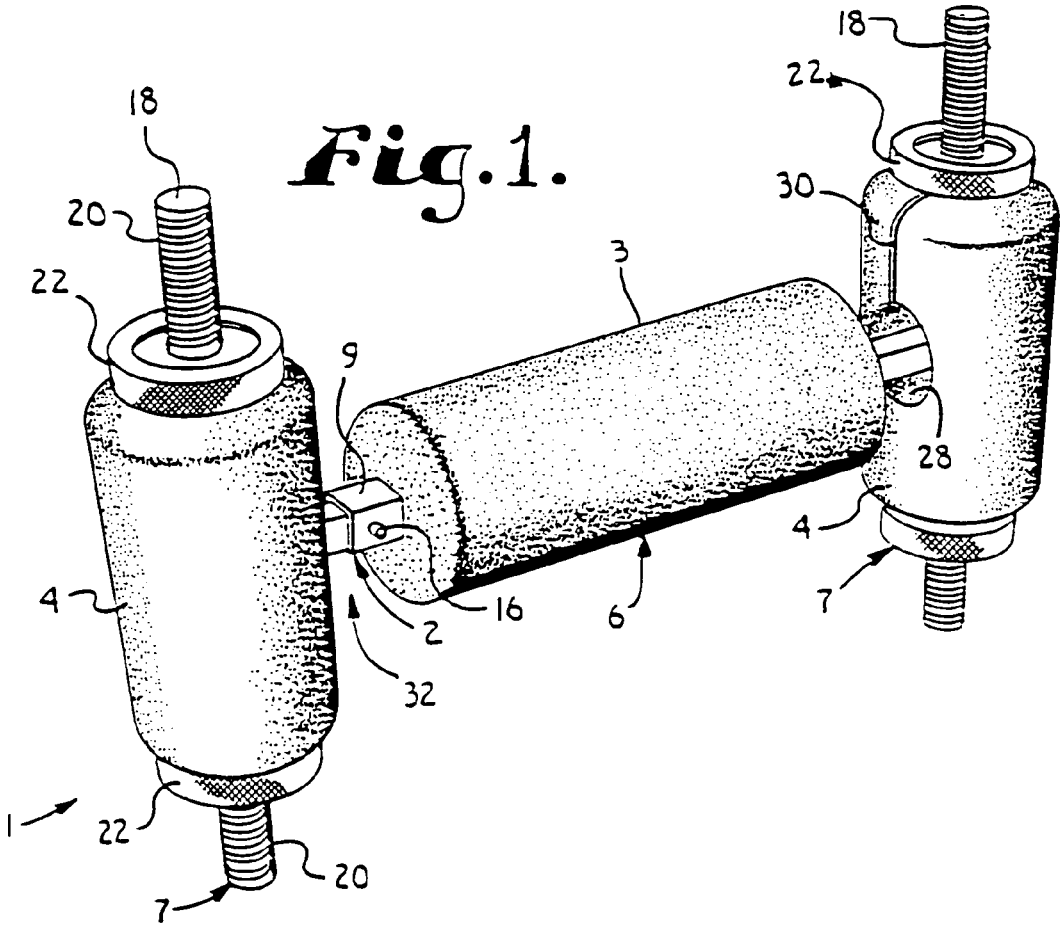
FIG. 1 is a perspective view of an open hand gripped exercise device.
Figure 2:
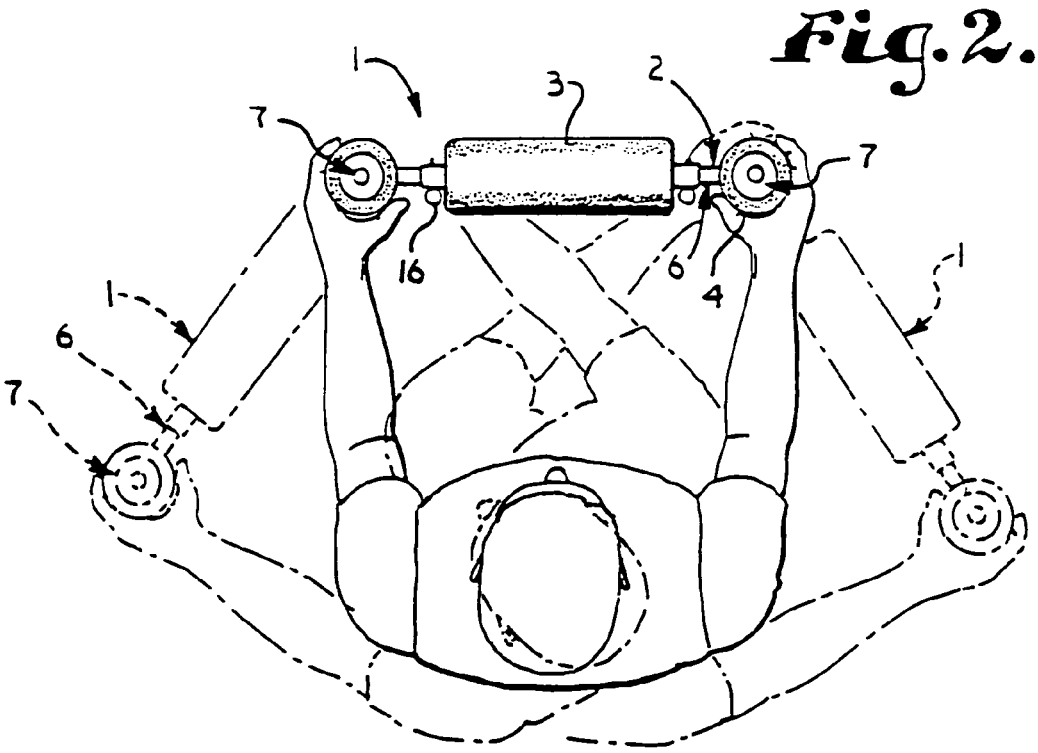
FIG. 2 is a top plan view at a reduced scale and illustrates gripping of the exercise device by a user in a substantially open handed manner, with movement of the device by the user shown in phantom lines.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 1 generally designates an open hand gripped exercise device. The device 1 generally includes an inner frame 2 and external cushions or grips 3 and 4 sized to conform to a substantially open handed grip of a user of the device 1 when used for exercises.

Referring to FIG. 3, the preferred frame 2 is H-shaped and includes a center bar assembly 6 and opposite end bar assemblies 7. The center bar assembly 6 includes a center section 9 and a pair of end stub sections 10 telescoped into the center section 9. The illustrated center bar sections 9 and 10 are tubular and of square cross section, although other cross sectional shapes could alternatively be employed. As shown in FIG. 4, the center section 9 is provided with apertures 14 at its opposite ends and the end stub sections 10 with apertures 15. The apertures 15 are selectively aligned with the apertures 14 to receive a fastener 16, such as a "cotterless" pin, to secure the end sections 10 to the center section 9, by snapping the fastener 16 into the aligned holes 14 and 15. The apertures 14 and 15 and fastener 16 enable the length of the center bar assembly 6 to be adjusted through a range of about two feet to three feet.

The preferred end bar assemblies 7 are solid rods 18, each having a center rod section 19 and a pair of end rod sections 20. The end sections 10 of the center bar assembly 6 are connected to the center rod sections 19, as by welding, to form perpendicular or T-shaped joints. The end rod sections 20 are threaded to receive internally threaded collars or nuts 22. The collars 22 provide a means of securing external weight plates 24 to the rod assemblies 7. The collars 22 add weight to the device 1 and may be placed on the rods 18, or not, as desired by the user. The rods 18 may include stop shoulders 26 to restrict the position of a weight plate 24 on the rods 18 to the end sections 20 of the rods 18 and to prevent threading a collar 22 onto a center section 19 of a rod 18.

The illustrated center bar cushion 3 and end bar cushions 4 are cylindrical in shape and centrally bored to be received on the center bar 6 and the end bars 7 respectively. The cushions 3 and 4 may be formed of foam plastic of medium density and resilience. The cushions 3 and 4 have an outer diameter which requires a substantially open handed grip by a user to grasp the cushions 3 and/or 4 to support the device during exercising and, preferably, have a diameter in a range of about four to six inches. Although not illustrated, the cushions 3 and 4 may include an outer covering, such as leather or a plastic sheeting material, to protect the cushions. The illustrated end bar cushions 4 have a cross bore 28 and an end slit 30 (FIG. 1) to facilitate placement of the cushions 4 on the end bar rods 18 and to provide clearance around the end stubs 10 of the center bar assembly 6. Although it is desirable for the diameter of the cushions 3 and 4 to be of such a diameter as to require an open handed grip, it is recognized that, for safety, a secure grip on the device 1 is also necessary. In the illustrated device 1, there is a gap 32 between the ends of the center cushion 3 and the end cushions 4 in the region of the joint between the center section 9 and end sections 10 of the center bar assembly 6.

The gap 32 provides access to the fasteners 16 to adjust the length of the center bar assembly 6 and also allows secure gripping of the device 1. When the center bar assembly 6 is extended, the gap 32 is correspondingly increased, providing an expanded length of center bar 6 for gripping.

The illustrated exercise device 1 weighs from eight to ten pounds, without the collars 22. The collars 22 weigh about one pound apiece. The end rods 18 are similar to conventional dumbbell bars and are adapted to receive conventional weight plates, such as the plates 24. Common weight increments for the plates 24 are 1.25, 2.5, and 5 pounds. It is foreseen that other weight increments could be employed, such as metric increments. The total weight of the device 1 is limited by the length of the rods 18 and the ability of the user to safely lift and manipulate such weight. It should be noted that significant training benefits can be realized using only the device 1 with the collars 22. It is generally recommended that only minimal amounts of weight be added to the basic device 1, for most exercises.

The device 1 has utility in a wide variety of exercises. A particular feature of the device 1 is the sizing of the center cushion 3 and end cushions 4 to encourage an open-handed grip of the device during exercises. An open-handed grip requires constant contraction of certain muscles to support and control the device 1. As a result, a clamping or compressing approach to supporting the device 1 is required, thus providing isometric or quasi-isometric exercise of the arms and upper body, in addition to muscles used for other aspects of the exercises, such as manipulation of the device. As used herein, an open handed grip generally refers to a grip in which the curvature of the hand from the tips of the fingers to the tip of the thumb is generally C-shaped and forms approximately half a circle or less.

It is foreseen that the center bar assembly 6 could be a single bar or rod of fixed length with the end bar assemblies 7 welded to opposite ends thereof (not shown). It is also foreseen that the center bar assembly 6 could comprise an outer telescoping member connected to one of the end bar assemblies 7 and an inner telescoping member connected to the other end bar assembly 7. The inner telescoping member would then be telescopingly received within the outer telescoping member. It is also foreseen that the center bar assembly 6 could be made adjustable without the use of fasteners as such. For example, a detent mechanism (not shown) could be engaged between telescoping members of the center bar assembly 6.

Figure 5:
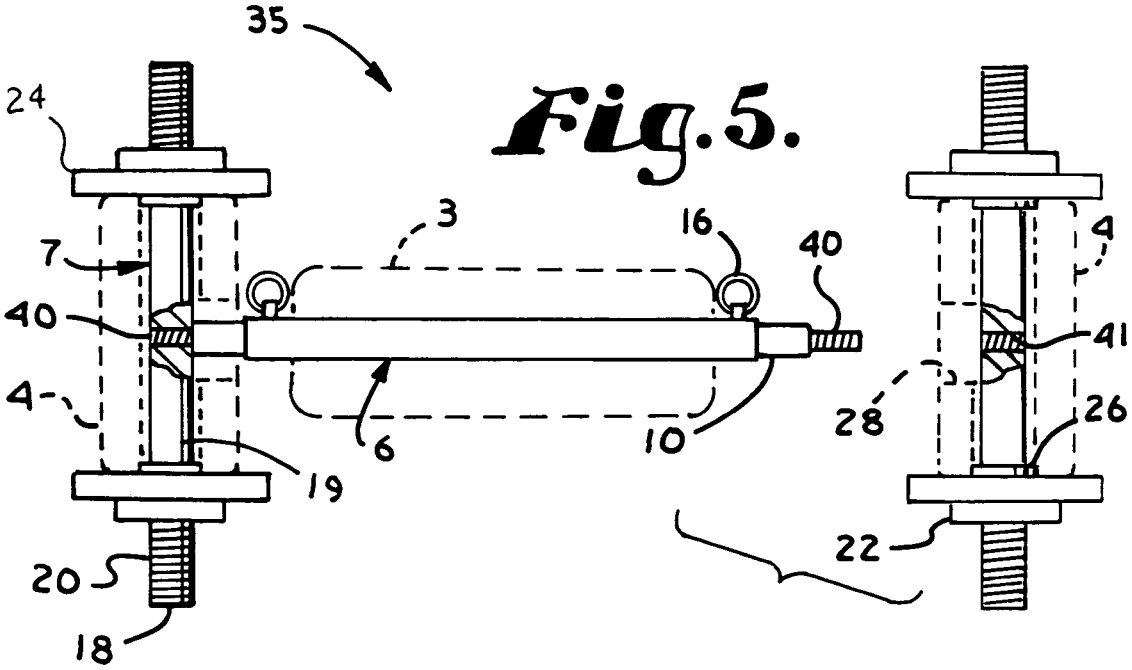
FIG. 5 is a partially exploded, side elevational view similar to FIG. 3, with portions broken away to show detail, showing an alternative embodiment in which dumbbells are rotatably connected to the center bar by threaded connectors to permit removable and rotatable connection of the dumbbells to the center bar.
Figure 6:
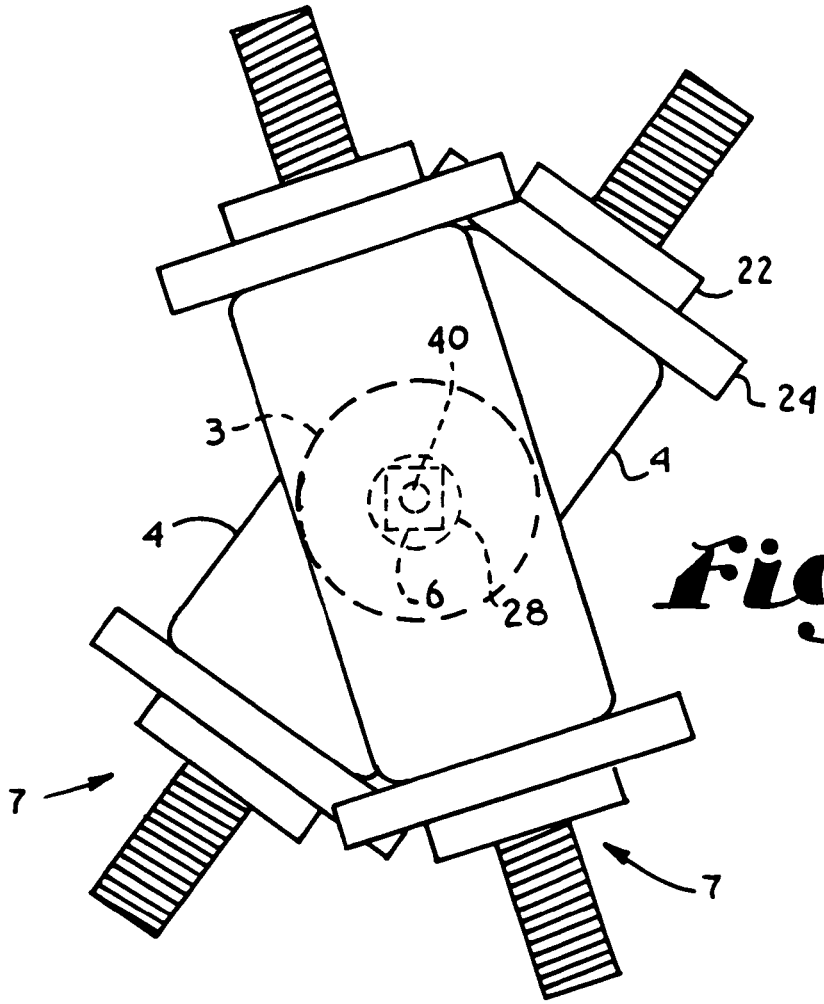
FIG. 6 is an end view of enlarged scale showing the dumbbells pivoted relative one another and relative to the center bar shown in phantom lines.

FIGS. 5 and 6 show a hand held exercise device 35 comprising an alternative embodiment to the exercise device 1 in which the end bar assemblies 7 are removably and rotatably or pivotably attached to the center bar assembly 6. Except for the manner of connection of the end bar assemblies 7 to the center bar assembly 6, the construction of hand held exercise device 35 is essentially the same as device 1, therefore, the same reference numerals will be used in referring to the similar parts in addition, the alternative embodiment 35 will generally only be described with reference to those aspects which differ from the exercise device 1. As used herein, it is to be understood that the term dumbbell is used consistent with its ordinary meaning, and the end bar assemblies 7 may also be referred to as dumbbells 7. Although the dumbbells shown herein are of the type using weighted plates or disks to add weight, it is foreseen that dumbbells of fixed weight with weighted spheres or the like on the ends could be utilized.

In the alternative embodiment of exercise device 35, the dumbbells 7 are connected to the center bar assembly 6 by a threaded connection formed by a threaded stud 40 formed on the end of each end section 10 and a threaded receiver 42 formed in the rod center section 19 of each dumbbell 7. The threaded studs 40 extend axially outward from the end sections 10 of the center bar assembly 6 and the threaded receivers 42 are formed in the center of and extend transversely through the center section 19 of the rod or bar 18 of each dumbbell 7.

The threaded connection between the dumbbells 7 and the center bar assembly or cross-bar 6 permits the dumbbells 7 to be removably securable to the center bar assembly 6. When the exercise device 35 is to be used with the dumbbells 7 (with the end cushions 4 secured thereto) connected to the center bar assembly 6, the dumbbells 7 preferably are not threaded all the way onto the threaded studs 40 on the center bar assembly 6. In addition, in the embodiment shown in FIG. 5, no portion of the threaded studs 40 on opposite ends of the center bar assembly 6 extend beyond the distal surface of the center section 19 of the rod or bar 18 of each dumbbell 7 attached thereto. The end cushions 4 extend in covering relationship with the dumbbell center section 19 or rod or bar 18. The end cushions 4 extend at least partially around the center section of each of the dumbbells in covering relationship to a respective one of the opposite ends of the center bar. Each end cushion or resilient grip member 4 presents one of a pair of opposed gripping surfaces for gripping by a user during exercise, wherein opposite ends of the center bar assembly 6 do not extend beyond the gripping surfaces of the end cushions.

The loose connection between the dumbbells 7 and the center bar assembly 6 permits the dumbbells 7 to rotate or pivot relative to the center bar assembly 6 when in use to accommodate the natural positioning of the user's hands and wrists while using the device 35. For example, as a user holding the device 35 in both hands in front of their torso, rotates about the waist to the left or right, the relative position of the user's hands want to rotate relative to one another and the pivotal connection of the dumbbells 7 to the cross bar assembly 6 permits such adjustments in the positioning of the hands. It is foreseen that connection means other than the threaded connection could be utilized to provide a pivotal and removable connection between the dumbbells 7 and the center bar assembly 6. For example, the dumbbells 7 may be journaled to the center bar assembly in which case the each end of the center bar assembly 6 could comprise a pivot pin of reduced diameter extending through a hole in the rod center section 19 of an associated dumbbell 7. The dumbbell 7 could then be secured to the pivot pin by some for of clamping collar, cotter pin or the like. Alternatively, it is foreseen that the dumbbells 7 could be connected to the center bar assembly 6 by means which would permit the dumbbells 7 to pivot or rotate relative to the center bar assembly 6 but which would not permit the dumbbells 7 to be removed from or readily removed from the center bar assembly 6.

The removable connection between the dumbbells 7 and center bar assembly 6 permits the dumbbells 7 to be used separate from the rest of the device 35 and with or without the end cushions 4 connected thereto. As discussed above, the cushions 4 are removably securable around the center section 19 of the rods 18 of dumbbells 7. Referring to FIG. 1, the cushions 4, used in association with the exercise device 1 are shown with slit 30 extending partially across the cushion 4 to the counterbore 28 to facilitate attachment and removal of the cushions 4 on the end bar rods 18. It is to be understood that the slit 30 could be extended completely across the cushion 4 to facilitate removal and connection of the cushion 4 to the dumbbell 7. It is also to be understood that the cushions 4 used with the exercise device 35 could be formed without a slit, as generally shown in FIG. 6, since the dumbbells 7 of exercise device 35 do not include end stubs 10 on the center section 19 for which a slit would be necessary to provide clearance for removal and attachment of the cushions 4.

Figure 7:
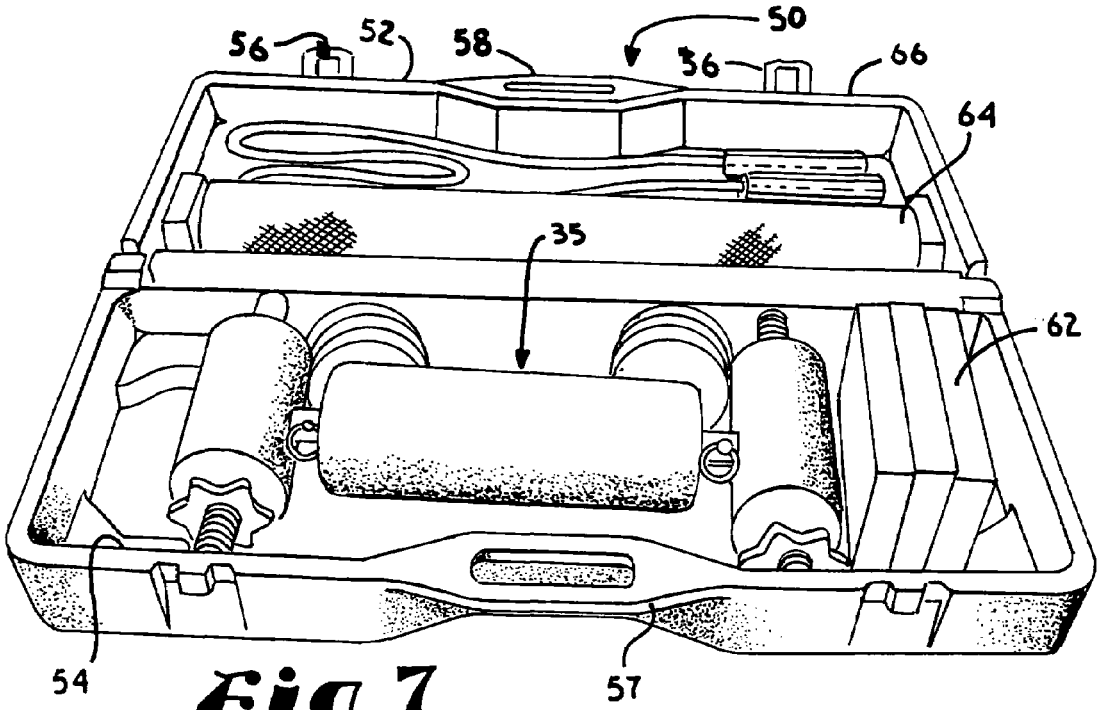
FIG. 7 is a perspective view of a carrying case for the exercise device and associated items with the carrying case shown open.

Referring to FIG. 7, a carrying case 50 is shown for use in storing and transporting the exercise device 1 or 35. The carrying case 50 is formed from a rigid plastic and is of a clam shell type construction with a bottom half 51 and a top half 52 connected together by a hinge 53. The bottom and top halves 51 and 52 when closed form a closed interior chamber 54 in which the exercise device 1 or 35 may be stored. The bottom and top halves 51 and 52 are held closed by latches 56 on the side of the halves 51 and 52 opposite the hinge 53. Handle halves 57 and 58 formed on each half 51 and 52 of the carrying case 50 form a handle 59 for the carrying case 50 when the halves 51 and 52 are closed.

Figure 8:
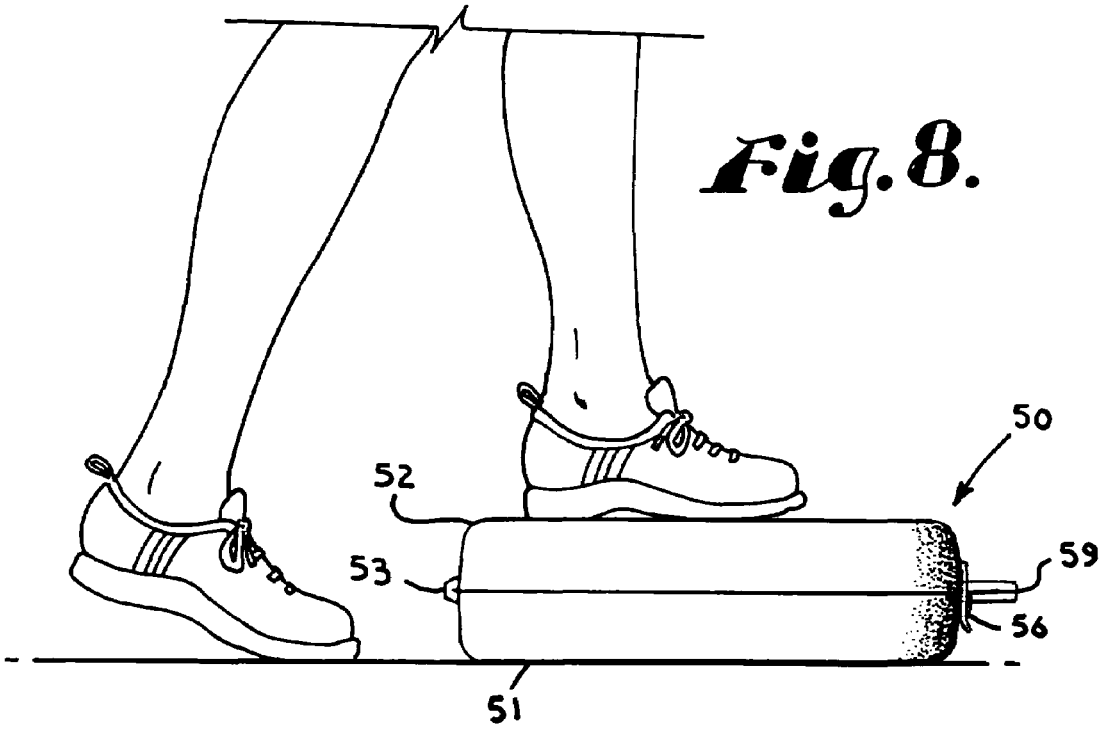
FIG. 8 is a side view showing the carrying case closed and being used as a step for a step type exercise.

In addition to storing the exercise device 1 or 35, the carrying case 50 can also be configured and used to store other items adapted for use in association with or in addition to the exercise device including recorded exercise programs 62, extra weight plates 24, a mat 64 on which to lay while exercising, a jump rope 66 or other selected exercise equipment. Referring to FIG. 8, the carrying case 50, when closed, can be used as a step for performing step type exercises. The outer surfaces of the carrying case 50 are preferably textured to present a relatively non-slip surface. Alternatively, it is foreseen that foam or rubber matting or strips may be secured to either or both of the top and bottom surfaces of the carrying case 50 to present a non-slip surface on the carrying case.

It is to be understood that while certain forms of the present invention have been illustrated and described herein, it is not to be limited to the specific forms or arrangement of parts described and shown. For example, although the dumbbells 7 are shown as extending perpendicular to the cross bar assembly 6, it is foreseen that the dumbbells could be angled relative to the cross bar assembly 6 with one end of each dumbbell 7 extending inward relative to the cross bar assembly and the other end extending outward relative thereto. It is to be understood that equivalents may be employed and substitutions made herein without departing from the scope of the invention as claimed.

What is claimed and desired to be secured by Letters Patent is as follows:

1. An exercise device comprising:

a) a cross bar having opposite ends;

b) a pair of dumbbells, each having a center section connected to one of said opposite ends of said cross bar, wherein said opposite ends of said cross bar generally do not extend beyond a distal surface of said center section of a respective one of said dumbbells connected thereto; and c) a resilient grip member extending at least partially around said center section of each of said dumbbells and presenting one of a pair of opposed gripping surfaces for gripping by a user during exercise.

2. The exercise device as in claim 1 wherein:

a) at least one of said dumbbells is removably securable to said cross bar.

3. The exercise device as in claim 1 wherein:

a) at least one of said dumbbells is rotatably secured to said cross bar.

4. The exercise device as in claim 1 wherein:

a) said dumbbells are removably securable to said cross bar and said resilient grip members are removably securable to said dumbbells.

5. The exercise device as in claim 1 in combination with a plastic carrying case for storing said exercise device and having opposed generally planar surfaces sized to function as a step for performing step type exercises.

6. An exercise device comprising:

a) a cross bar having opposite ends;

b) a pair of dumbbells, each having a center section connected to one of said opposite ends of said cross bar; and c) a resilient grip member extending at least partially around said center section of each of said dumbbells and in covering relationship to a respective one of said opposite ends of said cross bar, each of said resilient grip members presenting one of a pair of opposed gripping surfaces for gripping by a user during exercise and wherein said opposite ends of said cross bar do not extend beyond said gripping surfaces.

7. The exercise device as in claim 6 in combination with a plastic carrying case for storing said exercise device and having opposed generally planar surfaces sized to function as a step for performing step type exercises.

* * * * *